United States Patent [19]

Franzone

[11] 4,237,630

[45] Dec. 9, 1980

[54] PICTURE FRAME ASSEMBLY

[76] Inventor: John Franzone, 2220 Eastridge Rd., Timonium, Md. 21093

[21] Appl. No.: 25,341

[22] Filed: Mar. 30, 1979

[51] Int. Cl.[3] ..... G09F 1/12

[52] U.S. Cl. ..... 40/152

[58] Field of Search ..... 403/401, 402; 40/152, 40/156

[56] References Cited

U.S. PATENT DOCUMENTS

| | | | |
|---|---|---|---|
| 226,509 | 4/1880 | Fletcher | 403/401 |
| 587,241 | 7/1897 | Seidel | 40/152 |
| 909,080 | 1/1909 | Goodrow | 403/401 |
| 1,584,069 | 5/1926 | Anderson | 403/401 |
| 1,651,325 | 11/1927 | Bush | 403/401 |
| 2,581,843 | 1/1952 | Edwards | 40/156 X |
| 3,070,914 | 1/1963 | Henderson et al. | 40/156 |
| 3,246,414 | 4/1966 | Buehrer | 403/401 |
| 3,848,390 | 11/1974 | Annderson et al. | 403/401 |
| 3,946,511 | 3/1976 | Wiener | 40/152.1 |

*Primary Examiner*—Gene Mancene
*Assistant Examiner*—Wenceslao J. Contreras
*Attorney, Agent, or Firm*—John F. McClellan, Sr.

[57] ABSTRACT

A picture frame assembly of trapezoidal-troughlike members with "U"-clamped miter joints has an inwardly projecting picture mount flange structure with adjacent tapered-section sides adapted for detachable picture-retention by "U" clamps of the type having lateral arms, and by nails in holes provided with axial clearance by staggered offset of outer sides of the frame members relative to the inner sides; an alternative hybrid type miter joint securance employs both "U"-clamp and screw fastener.

2 Claims, 5 Drawing Figures

PICTURE FRAME ASSEMBLY

This invention relates generally to picture frames and specifically to picture frames made of plural pieces.

A principal object of this invention is to provide a picture frame system in which frames of various sizes can be assembled securely but detachably by connecting selected interchangeable pre-formed lengths of framing which provide for especially easy and simple attachment of parts and mounting of pictures using "U"-clips, alone or with screws.

in the prior art various picture frame structures have been disclosed, which employ assembly attachments of various types, some of which are "U"-clips, as indicated by the following U.S. Pat. Nos. 3,946,511, to Samuel G. Wiener, Jr. 3-30-76, 3,848,390 to William S. Anderson 12-19-74, 3,246,414 to W. Buehrer 4-19-66, 1,651,325 to L. M. Bush 11-29-27, 909,080 to W. Goodrow 1-5-09.

Wiener discloses pulling the side of the joint together with a member 17.

Anderson discloses a screw-forced clip pulling the joint together.

Buehrer employs a clip 18 for pulling the joint together.

Bush and Goodrow clip the joint together in similar manner to Wiener.

However, none of these prior art patents is seen to satisfy the objects and advantages of the present invention.

Further objects are to provide a picture frame system which can be quickly assembled without tools, which for simplicity provides generally similar fasteners for both mounting pictures and assembly of frame, which provides wide latitude in choice of fastener locations, which can be aligned by anyone after partial assembly if misaligned, which permits mounting and dismounting prints and/or pictures safely without need for dangerous manipulation of tools in close proximity, which can be quickly disassembled for moving, and which is attractive, economical and durable.

In brief summary given as cursive description only and not as limitation the invention includes a plurality of trapezoidal trough-shaped members co-acting with "U"-spring-type fasteners, alone or with screws.

The above objects and advantages will become more readily apparent on examination of the following description, including the drawings in which like reference numberals refer to like parts:

FIG. 1 shows the invention 10 in one embodiment in front view, assembled but without a picture, which normally would appear mounted behind the integral picture-mount flange 20 projecting inwardly and parallel with the frame.

The frame has a completely conventional appearance at the miter joints 22, the fasteners joining the end pieces 24 and top and bottom pieces 26 not being visible from the front.

Preferably the frame comprises the four separate pieces shown. They may be of any suitable material such as thermoplastic.

Preferably also, all the frame pieces incline forwardly from the innner edge out, as shown; in addition to imparting an attractive concave frontal aspect, this structure also has a functional advantage which will be seen. As other options the frame may have one or more decorative features such as the inward step 28 shown around the periphery, and the webs 36 may have any chosen decorative finish such as brushed metallic or simulated woodgrain finishes.

Figure 1:
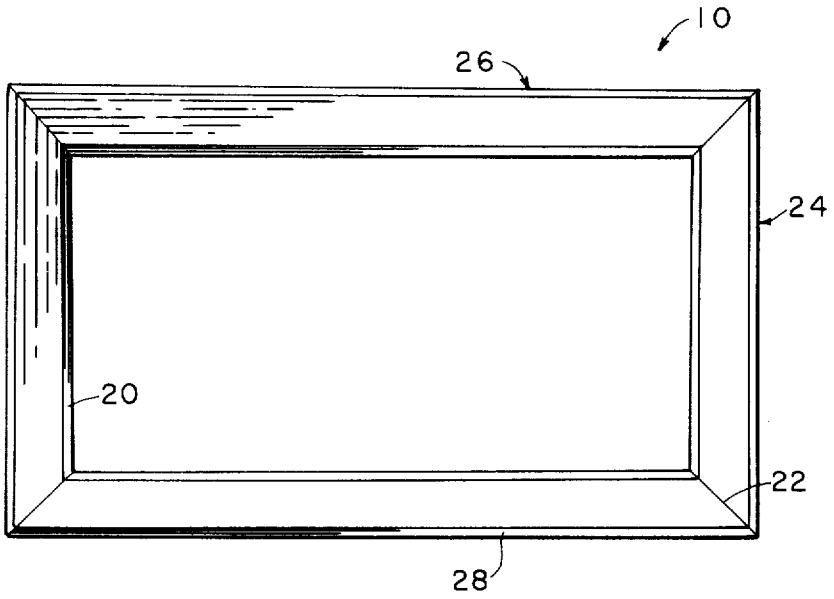
FIG. 1 is a front elevation of an assembled frame according to this invention.
Figure 2:
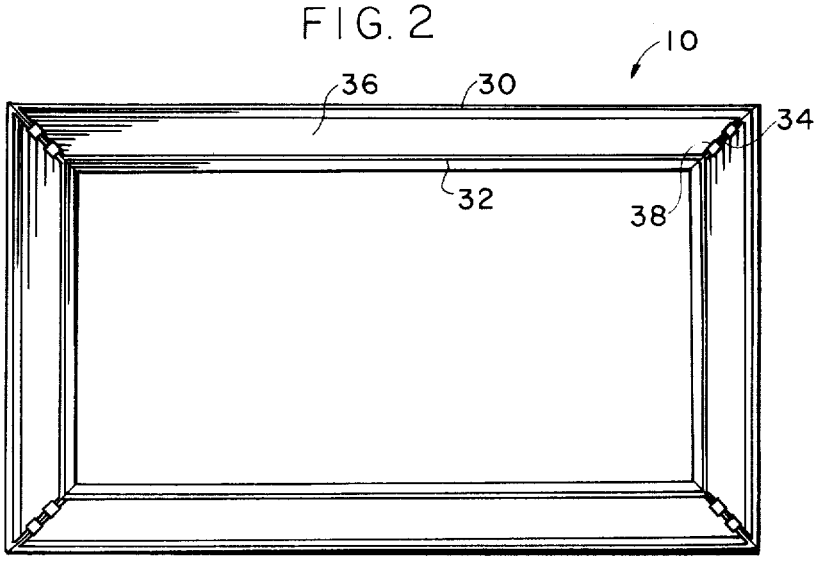
FIG. 2 is a rear elevation thereof.

FIG. 2 shows the rear view of the FIG. 1 embodiment. Each top and bottom piece and each end piece has long and short sides 30, 32, ands 34 integral web 36, forming a trapezoidal trough in rear elevational view.

"U"-shaped spring clips 38 over the abutting pairs of ends which form the miter joints hold the assembly together. All clips used are of spring force permitting easy manual installation.

Figure 3:
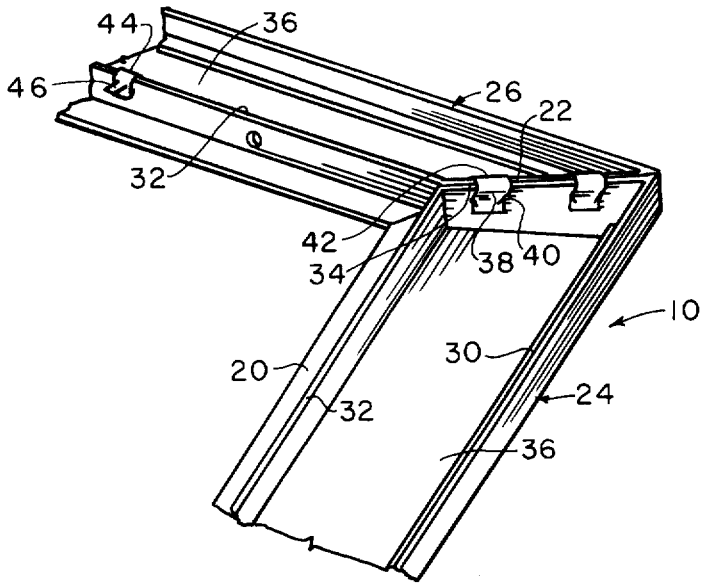
FIG. 3 is a perspective detail showing a portion of the frame assembled.

FIG. 3 indicates that the "U"-shaped spring clips 38 are preferably of the commercially available type having retrograde or fish-hook-like barbs 40. This feature does more than merely hold the pieces together, it also keeps them in plane. That is, because the miter joint contacting faces do not interlock but instead are planar and perpendicular to the frame plane, the relatively thin wall construction of the structure permits use of curved-top or narrow-aspect, relatively non-rocking clips, the tops 42 of which when fully inserted against the paired ends coact with the barbed parts to define the plane of the frame parts and keep the frame part in plane.

At least one clip is required at each mitre joint but because of the full, parallel-wall span of the joints and stiff, trough construction, location is not critical, and two or several can be placed anywhere along the joint. Pictures, prints or whatever is desired of the type, may be retained against the picture-mount flange 29 by another, similar, commercially available type "U"-leg spring clip 44 which has a laterally projecting spring arm 46 generally adjustably parallel-spaced from the picture-mount flange when the clip is mounted on the short side of a piece.

To permit easy installation and ready removal without placing a tool near the picture, the wall section of each short side may have tapered thickness as indicated in relation to the next Figure.

Figure 4:
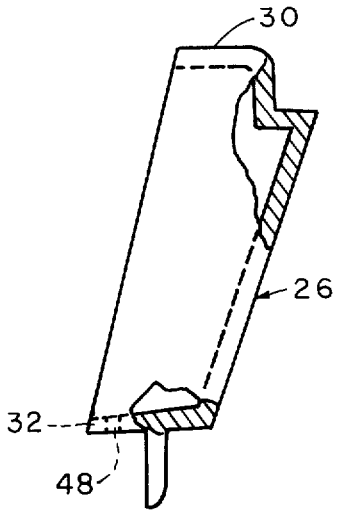
FIG. 4 is a partially sectional detail of an end of a frame portion.

FIG. 4 shows a sectional aspect of a piece. The short side 32 preferably has a shape rearwardly reducing in section, to the rear of the picuture-mount frame. In addition, at least one nail hole 48 is preferably provided perpendicularly through each short side in a position rearward of the picture mount frame. In the preferred embodiment a plurality of holes 48 is provided on four-inch spacing around the periphery. To permit convenient nailing by any user, skilled or not, into a canvas frame or the like to be mounted in the frame, clear hammer access axially of the nail hole is provided in that each long side 30 is staggered or offset forwardly from the respective inner side. The holes may also be used as hanging holes.

From this Figure also, the manufacturing simplicity and economy of the frame will be apparent. The wall thicknesses are nearly the same and the sides and ends are substantially parallel planes.

Figure 5:
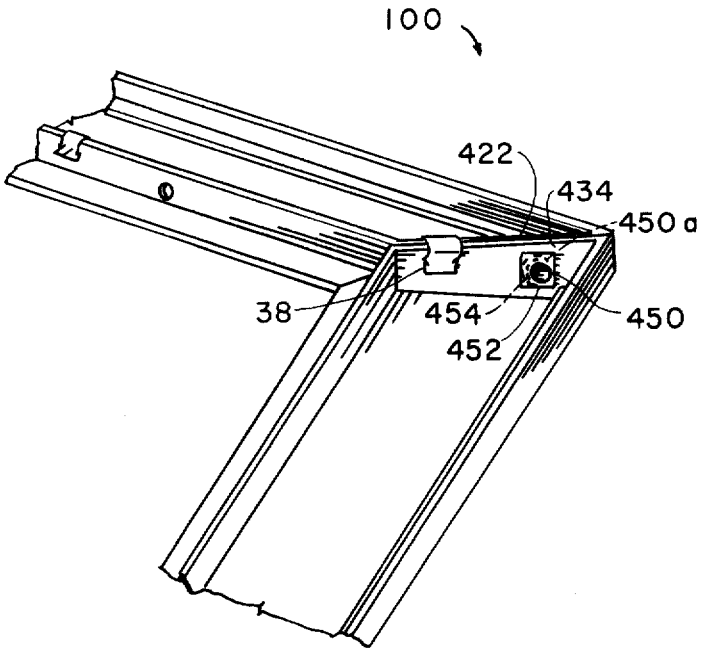
FIG. 5 is an alternative detail like FIG. 3.

FIG. 5 details a further, hybrid-fastener embodiment 100 in which at each miter joint 422 both a "U" clip 38 and a screw 450 secured with a typical commercially available flexible nut or sheet-metal nut 452 are employed. Use of a flexible nut permits push-on assembly in production set-up and provides economy. The screw is passed through aligned holes, 454 indicated in the respective ends 434 at the miter joint nearer the outer corner of the frame. The U-clip (or U-clamp) is applied near the inner corner. Preferably the screws are applied first for easiest alignment and the U-clips then spring-clamp the inner portions of the frame for speed, economy and greater reliability, the two fasteners preventing the long joint from flexing. Screwdriver access to the screw heads 450*a* permitting the use of screws is assured by the earlier described forward incline from the inner edge out of the frame pieces. Otherwise access would require use of a special offset screwdriver, not usually available in the home.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a picture frame made of plural pieces joined by "U"-clips at mitre joint structures, the improvement comprising: each piece having a web, integral long and short sides and ends on each web forming a trapezoidal trough therewith in rear plan view; each mitre joint structure formed of abutting ends of a pair of adjacent pieces, means joining each pair of abutting ends; an integral picture-mount flange structure projecting in a direction inwardly and parallel with respect to the frame from each of the short sides; means for retaining a picture against the picture-mount flange structure; the means for retaining including at least one nail-hole through each short side rearwardly of the picture mount flange structure, each long side being forwardly offset relative to the respective short side a distance providing axial access therepast to said at least one nail hole; said forward offset including an inclining of all said webs producing a concave front aspect of the webs in the frame; the means for retating including each short side having reducing sectional thickness rearwardly of the picture-mount flange, a "U"-leg clip of the type having a lateral projection, proportioned for engagement over said reducing section with the lateral projection in spaced parallel relation with the picturemount flange the means joining; including at least one "U"-clip and additionally each pair of abutting ends having a screwhole therethrough, a screw in each screwhole for attaching each said pair of abutting ends together, and said forward offset of each long side relative to the respective short side providing screwdriver access to each said screw.

2. In a rectangular picture frame made of plural pieces detachably joined at mitre joint structures at the respective corners thereof, each piece having a web, integral long and short sides and ends on the each web forming a trapezoidal trough therewith in rear plan view, the long sides being forwardly offset relative to the short sides, each mitre joint structure formed of abutting ends of a pair of adjacent pieces; a plurality of means joining each pair of abutting ends, a first of said plurality of means comprising a screw therethrough, a second of said plurality of means comprising a "U"-clip thereover, and each said screw being closer to an outer portion of the rectangular picture frame than the corresponding "U"-clip, and said offset providing improved screwdriver access to each said screw.

* * * * *